US011123856B2

(12) United States Patent
Lin

(10) Patent No.: US 11,123,856 B2
(45) Date of Patent: Sep. 21, 2021

(54) FAST ROTATION STRUCTURE OF WRENCH AND WRENCH THEREOF

(71) Applicant: Yu-Chiang Lin, Changhua County (TW)

(72) Inventor: Yu-Chiang Lin, Changhua County (TW)

( * ) Notice: Subject to any disclaimer, the term of this patent is extended or adjusted under 35 U.S.C. 154(b) by 386 days.

(21) Appl. No.: 16/265,987

(22) Filed: Feb. 1, 2019

(65) Prior Publication Data

US 2020/0246961 A1 Aug. 6, 2020

(51) Int. Cl.
*B25G 1/00* (2006.01)
*B25B 23/00* (2006.01)
*B25B 13/46* (2006.01)

(52) U.S. Cl.
CPC ..... *B25G 1/005* (2013.01); *B25B 13/462* (2013.01); *B25B 23/0035* (2013.01)

(58) Field of Classification Search
CPC ..... B25G 1/005; B25B 13/462
USPC ..... 81/177.2, 177.5, 177.6, 58.1, 185.2, 183
See application file for complete search history.

(56) References Cited

U.S. PATENT DOCUMENTS 766,577 A * 8/1904 Ansorge ..... B25B 13/463 81/60
1,359,325 A * 11/1920 Butler ..... B25B 13/463 81/58.1
4,748,874 A * 6/1988 Sharp ..... B25B 13/461 81/177.2
9,522,459 B2 * 12/2016 Cook ..... B25B 13/465
2016/0375573 A1 * 12/2016 Huang ..... B25G 1/043 81/177.2

* cited by examiner

*Primary Examiner* — Hadi Shakeri

(57) ABSTRACT

A fast rotation structure of wrench and wrench thereof are provided. The fast rotation structure includes a seat and a rocker arm. The seat is connected with the ratchet head of the wrench. The rocker arm and the seat are integrally formed or slidably combined. The rocker arm protrudes from one side of the seat, so as to drive the seat to rotate from an outer side of the seat. Therefore, the ratchet head is able to efficiently rotate.

6 Claims, 8 Drawing Sheets

FAST ROTATION STRUCTURE OF WRENCH AND WRENCH THEREOF

BACKGROUND OF THE INVENTION

1. Field of the Invention

The present invention relates to rotation structures of wrench, and more particularly, to a fast rotation structure of wrench for fast rotating the ratchet head.

2. Description of the Related Art in the industry, a wrench having a ratchet head is applied for rotating the rotation member (screw or nut) to be fastening or loosening the rotation member. By use of the unidirectional driving function of the wrench, when driving the rotation member, the user does not need to repeatedly combine the wrench and the rotation member, improving the operation efficiency.

However, regarding a conventional wrench, when the rotation member is combined with the object with almost no resistance force existing between the rotation member and the object, when the sleeve of the wrench is combined with the rotation member for carrying out the rotation motion, the unidirectional rotation of the wrench with respect to the rotation member is prevented. As a result, the rotation member will rotate forward and backward altogether with the rotation of the wrench. Therefore, when the user wishes to continue the rotation of the rotation member with respect to the object, the user will usually rotate the rotation member by a bare hand. However, before rotating the rotation member by hand, the user needs to separate the wrench from the rotation member. In other words, the user is unable to finish the rotation operation of the rotation member by use of only the wrench, causing the inconvenience of driving the rotation member with the wrench and a lower operation efficiency.

Therefore, the solution for the issues above is needed as an objective of the present invention.

SUMMARY OF THE INVENTION

For improving the issues above, a fast rotation structure of wrench and the wrench thereof are disclosed. With a rocker arm and the seat being integrally formed or slidably combined, and the rocker arm being able to protrude from one side of the seat, the rocker arm is applied for driving the seat to rotate from the outer side of the seat, so as to fast rotate the ratchet head which is linked with the seat.

For achieving the aforementioned objectives, a fast rotation structure of wrench is provided for fast rotating the ratchet head of the wrench. The fast rotation structure comprises:

a seat having a predetermined height and connected with the ratchet head; and a rocker arm integrally formed or slidably combined with the seat, the rocker arm protruding on one side of the seat for driving the seat to rotate from an outer side of the seat.

For achieving the aforementioned objectives, a wrench having a fast rotation structure is provided, comprising:

a wrench having a driving end, with a ratchet head disposed at the driving end;

a seat having a predetermined height and connected with the ratchet head; and a rocker arm integrally formed or slidably combined with the seat, the rocker arm protruding on one side of the seat for driving the seat to rotate from an outer side of the seat.

With such configuration, when the rotation member is combined with an object with almost no resistance force existing between the rotation member and the object, the rocker arm is applied for driving the seat to rotate by use of the rocker arm, thereby fast rotating the ratchet head for fast rotating the rotation member which is rotationally disposed on the object. The rotational fastening or loosening operation of the rotation member with respect to the object is able to be finished without the need of separating the wrench from the rotation member, facilitating the convenience of driving the rotation member with the wrench. Also, a greater efficiency of rotationally fastening or loosening the rotation member is achieved.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 8, a fast rotation structure of wrench in accordance with an embodiment of the present invention comprises a wrench 10, a seat 20, and a rocker arm 30.

Figure 1:
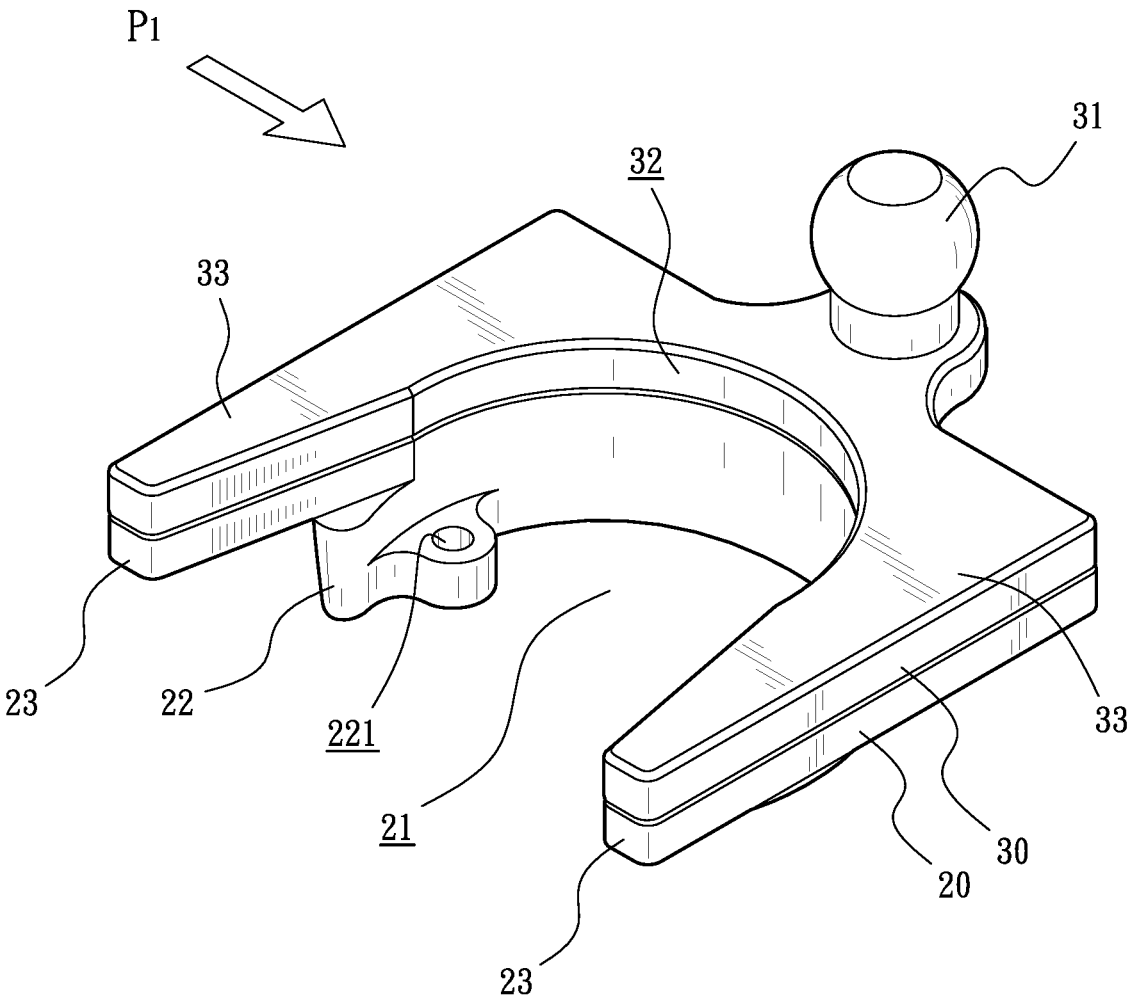
FIG. 1 is a perspective view of the fast rotation structure in accordance with an embodiment of the present invention, wherein the seat and the rocker arm are at the folding position.
Figure 2:
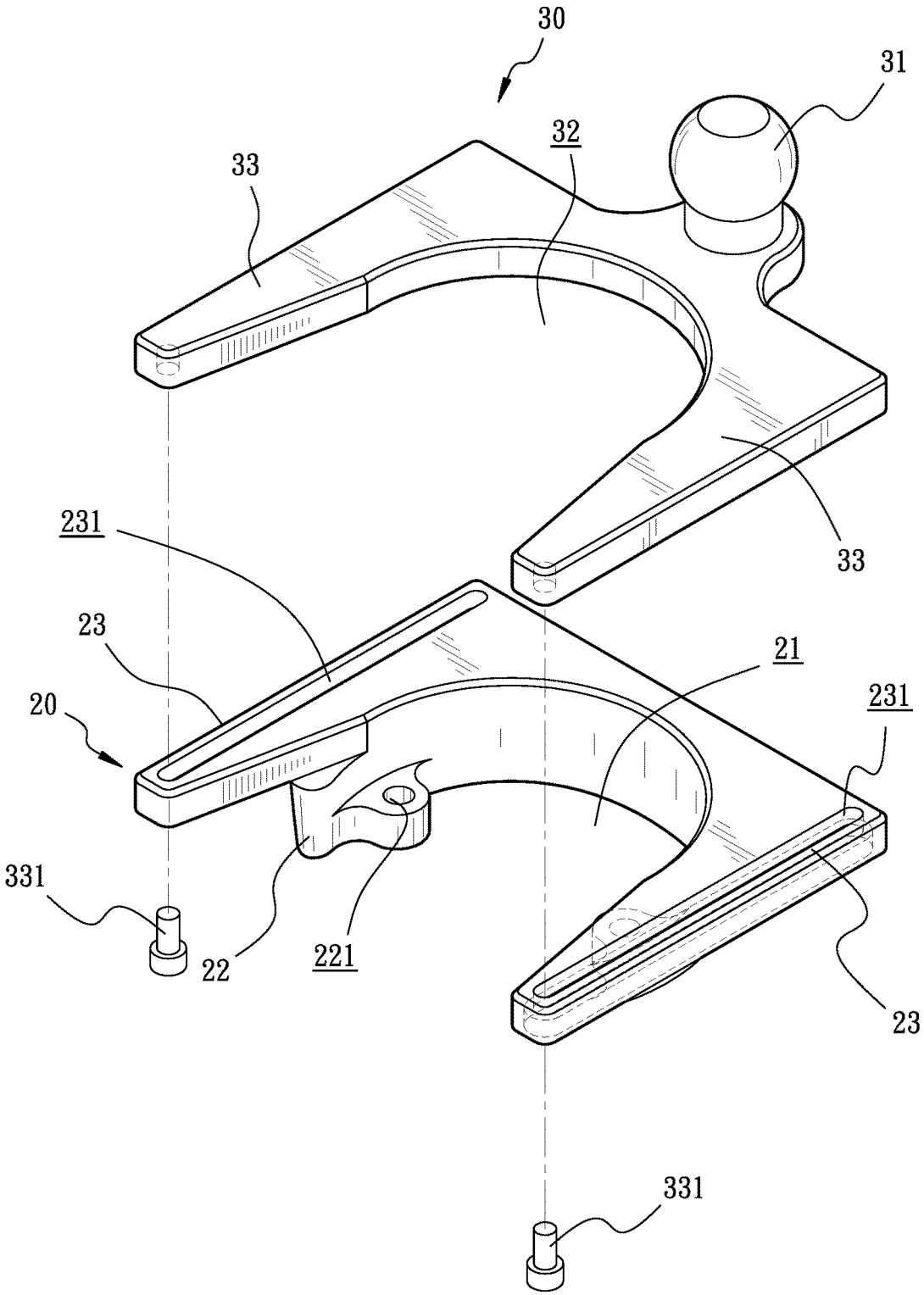
FIG. 2 is an exploded view illustrating the combination between the seat and the rocker arm
Figure 3:
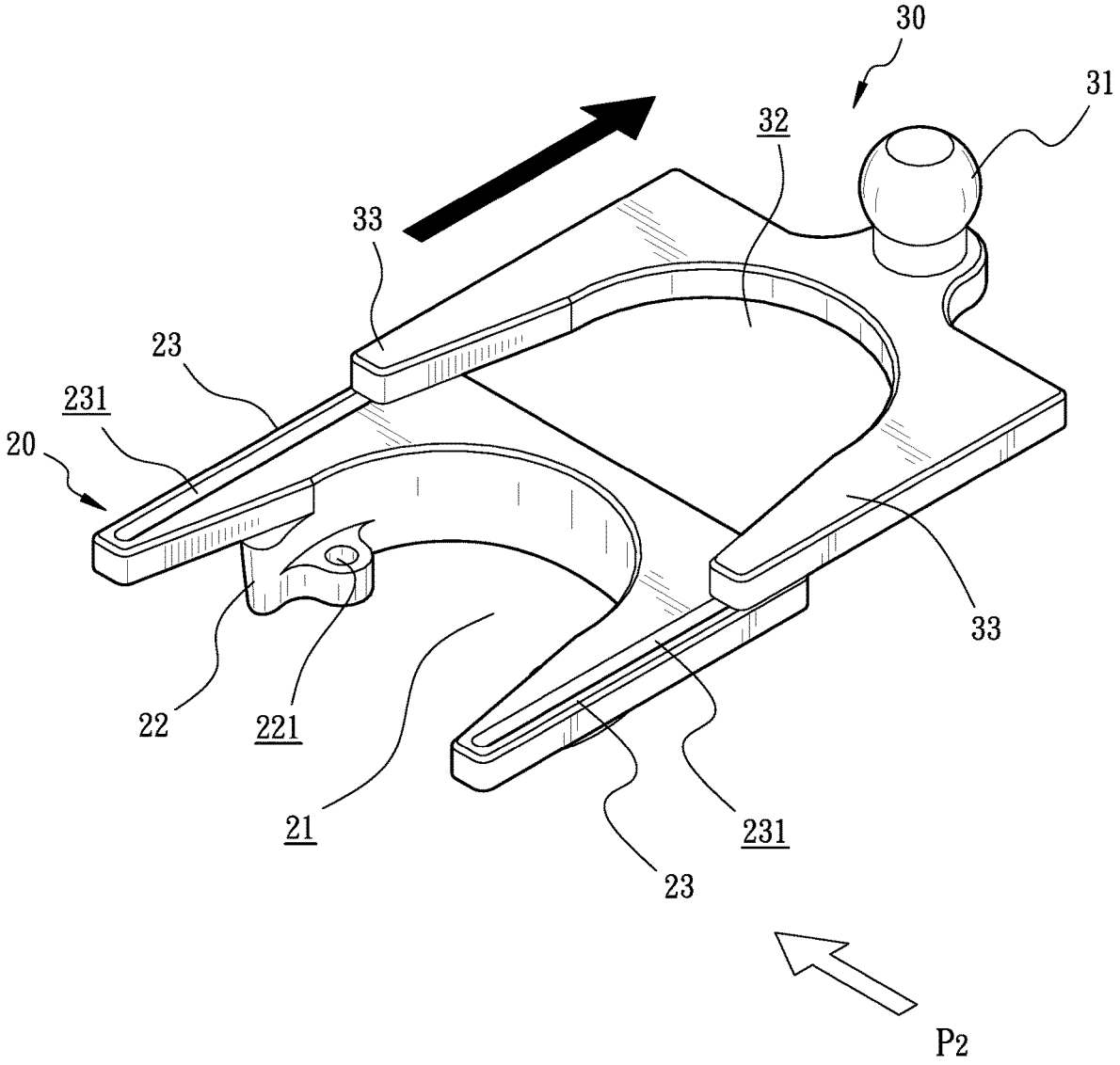
FIG. 3 is a perspective view of the rotation structure, wherein the seat and the rocker arm are at the driving position.
Figure 4:
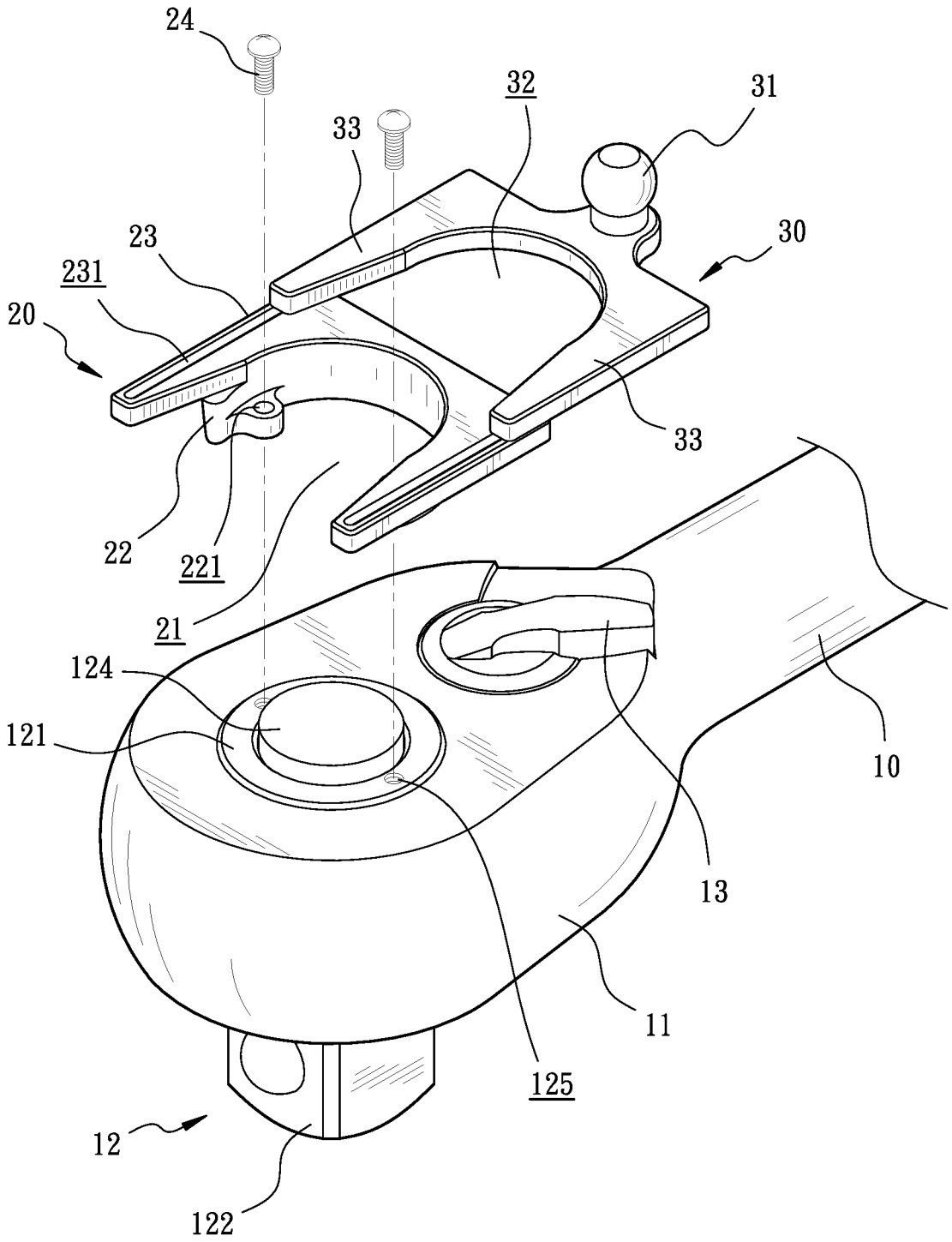
FIG. 4 is a schematic view illustrating the fast rotation structure being combined with a wrench.
Figure 5:
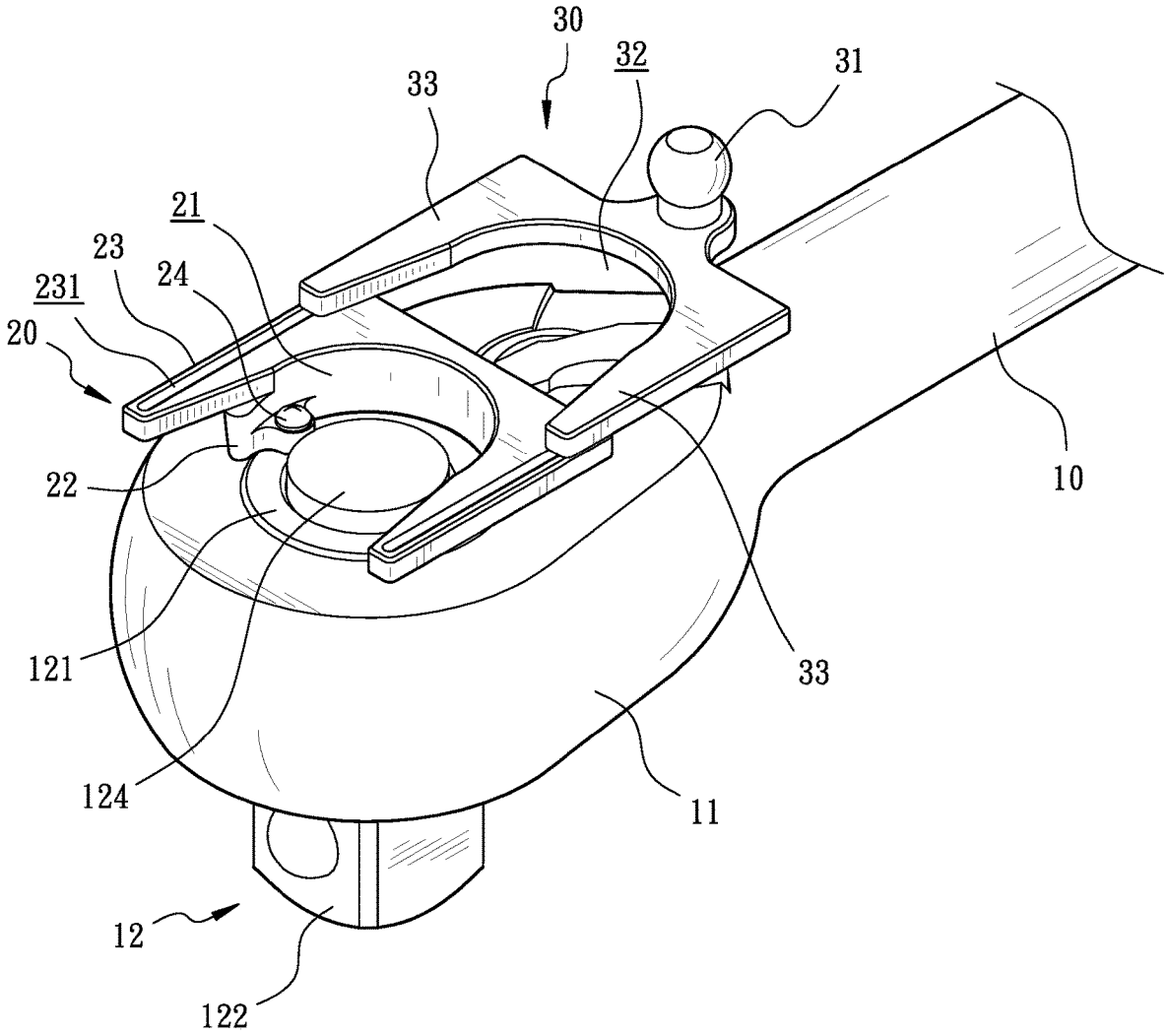
FIG. 5 is another schematic view illustrating the fast rotation structure being combined with a wrench.
Figure 6:
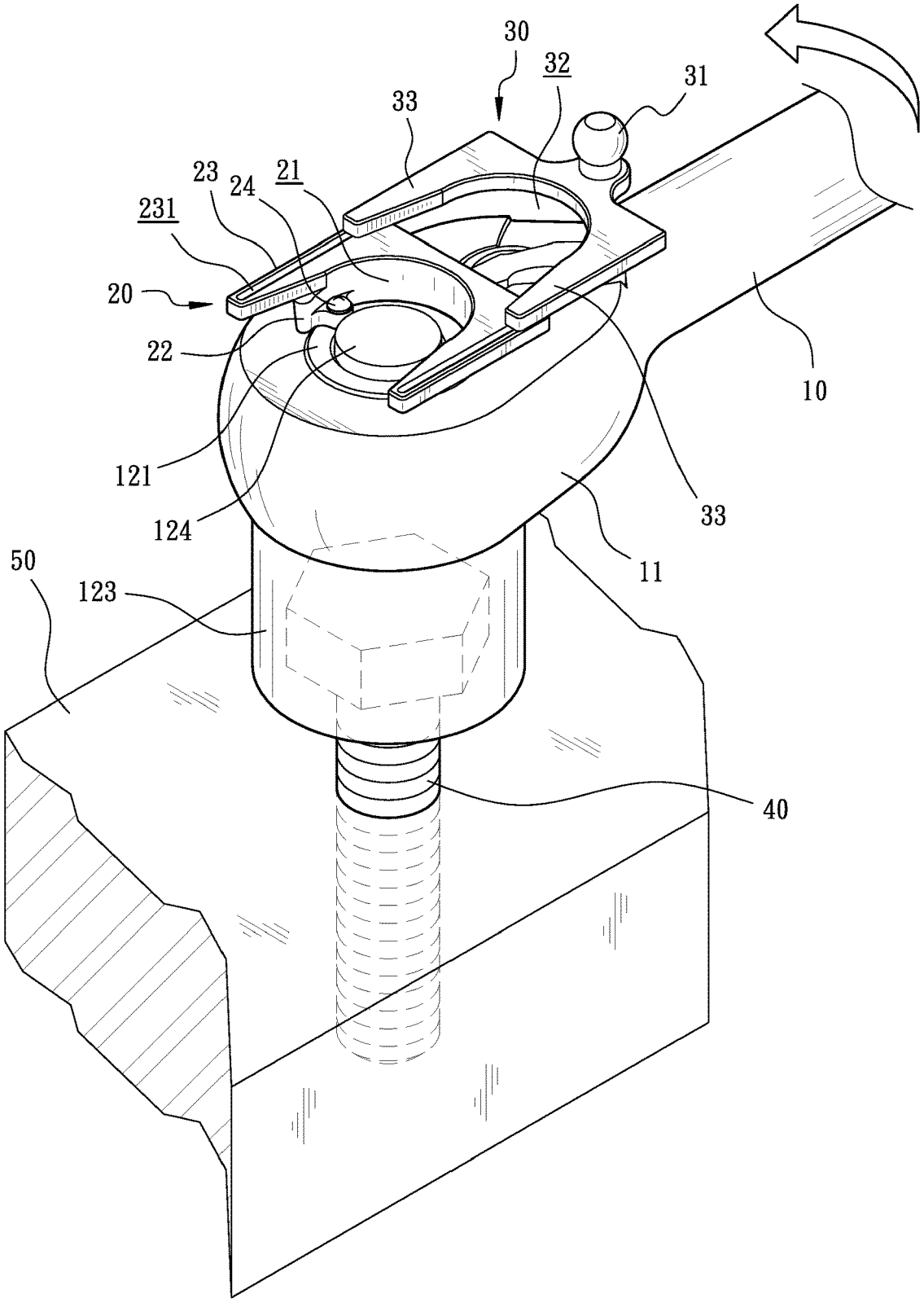
FIG. 6 is a schematic view illustrating the wrench in accordance with an embodiment of the present invention driving the rotation member counterclockwise with the sleeve.
Figure 8:
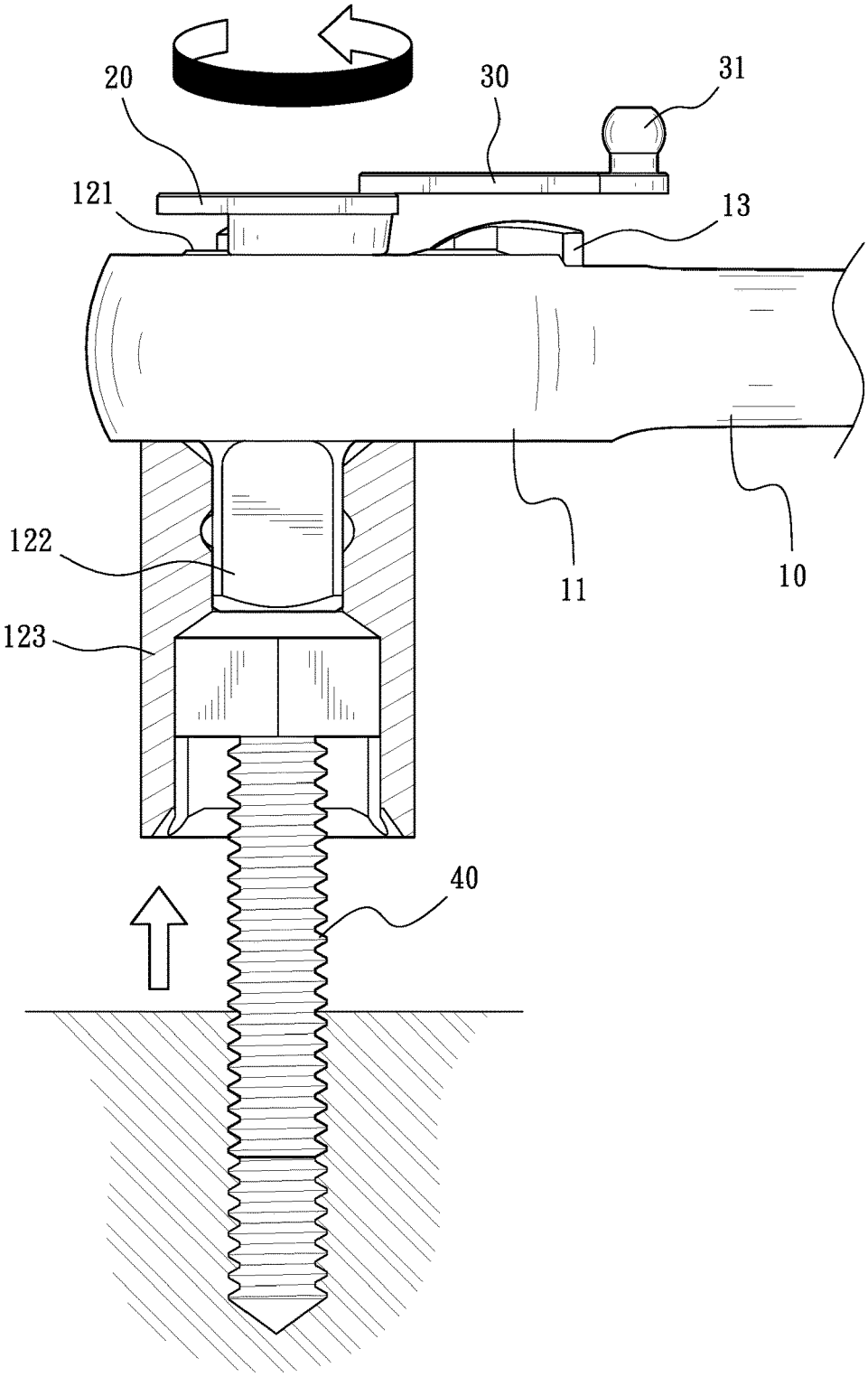
FIG. 8 is a schematic view illustrating the seat rotating to driven the screw to rotate upward with the sleeve.

The wrench 10 has a driving end 11, with a ratchet head 12 disposed at the driving end 11. In an embodiment of the present invention, the ratchet head 12 has a main body 121 disposed at the driving end 11 and an operation portion 122 extending from one side of the driving end 11. The main body 121 is engaged by ratchet teeth (now shown) in the driving end 11 to be rotatable in a single direction. The operation portion 122 is connected with a sleeve 123 for combining the rotation member, wherein the rotation member is, for example but not limited to, a screw 40 (as shown by FIG. 6 and FIG. 8) or a nut.

In an embodiment of the present invention, the ratchet head 12 has a press button 124 disposed at the center thereof.

When the sleeve 123 received by the operation portion 122 is to be released, the press button 124 is pressed for detaching the sleeve 123 from the operation portion 122. Also, in an embodiment of the present invention, the wrench 10 is a bidirectional driving wrench, which has a switch 13 which is switchable between the center position and two sides thereof, whereby the wrench 10 is able to be unidirectionally rotate clockwise or counterclockwise. Nevertheless, such wrench 10 is only for illustrating the technical features of the present invention, thus not limited to the aforementioned bidirectional driving wrench. A unidirectional driving wrench is also in the claim scope of the present invention.

The seat 20 has a predetermined height and is connected with the ratchet head 12. In an embodiment of the present invention, the rocker arm 30 and the seat 20 are slidably-combined. The rocker arm 30 protrudes from one side of the seat 20, so as to be applied for driving the seat 20 to rotate from the outer side of the seat 20.

In an embodiment of the present invention, the seat 20 is formed in a U shape and has a first opening. The seat 20 also has a lower wall 22, such that the seat 20 is connected with the ratchet head 12 by the lower wall 22. The rocker arm 30 has a rocker handle 31 disposed at end in opposite to the first opening 21, wherein the rocker handle 31 protrudes on the rocker arm 30. In an embodiment of the present invention, the seat 20 has two first lateral portions symmetrically disposed on two sides of the first opening 21, respectively. In the embodiment, the lower wall 22 has two apertures 221 disposed on two opposite sides of the first opening 21, respectively. Also, the ratchet head 12 has two lock holes 125 disposed corresponding to the two apertures 221, such that the two apertures 221 of the lower wall 22 are fastened to the two lock holes 125 through two fastening members 24, respectively.

In the embodiment, corresponding to the seat 20, the rocker arm 30 is also formed in a U shape and has a second opening 32. The rocker arm 30 has two second lateral portions 33 symmetrically disposed on two sides of the second opening 32, respectively. The two second lateral portions 33 of the rocker arm 30 slidably overlap the two first lateral portion 23, with the first opening 21 and the second opening 32 facing the same direction.

Further, in the embodiment, each first lateral portion 23 has a rail groove 231 which extends in a straight line orientation, and the rail grooves 231 of the two first lateral portion 23 are arranged in parallel. Also, in the embodiment, each second lateral portion 33 has a slide portion 331, such that the two slide portions 331 are disposed in the rail groove 231 of the two first lateral portions 23, respectively, whereby the rocker arm 30 disposed on the seat 20 is only allowed to move in a straight direction between a folding position P1 and a driving position P2. At the folding position P1, the rocker arm 30 slides with respect to the seat 20, so as to position the two slide portions 331 at one end of the rail groove 231 adjacent to the first opening 21, wherein a maximum of overlapping area between the second lateral portion 33 and the first lateral portion 23 is achieved, and a minimum of the length extension between the second lateral portion 33 and the first lateral portion 23 is achieved. At the driving position P2, the rocker arm 30 slides toward a direction away from the seat 20, so as to position the two slide portion 331 at one end of the rail groove 231 away from the first opening 21, wherein a minimum of overlapping area between the second lateral portion 33 and the first lateral portion 23 is achieved, and a maximum of the length extension between the second lateral portion 33 and the first lateral portion 23 is achieved.

Figure 7:
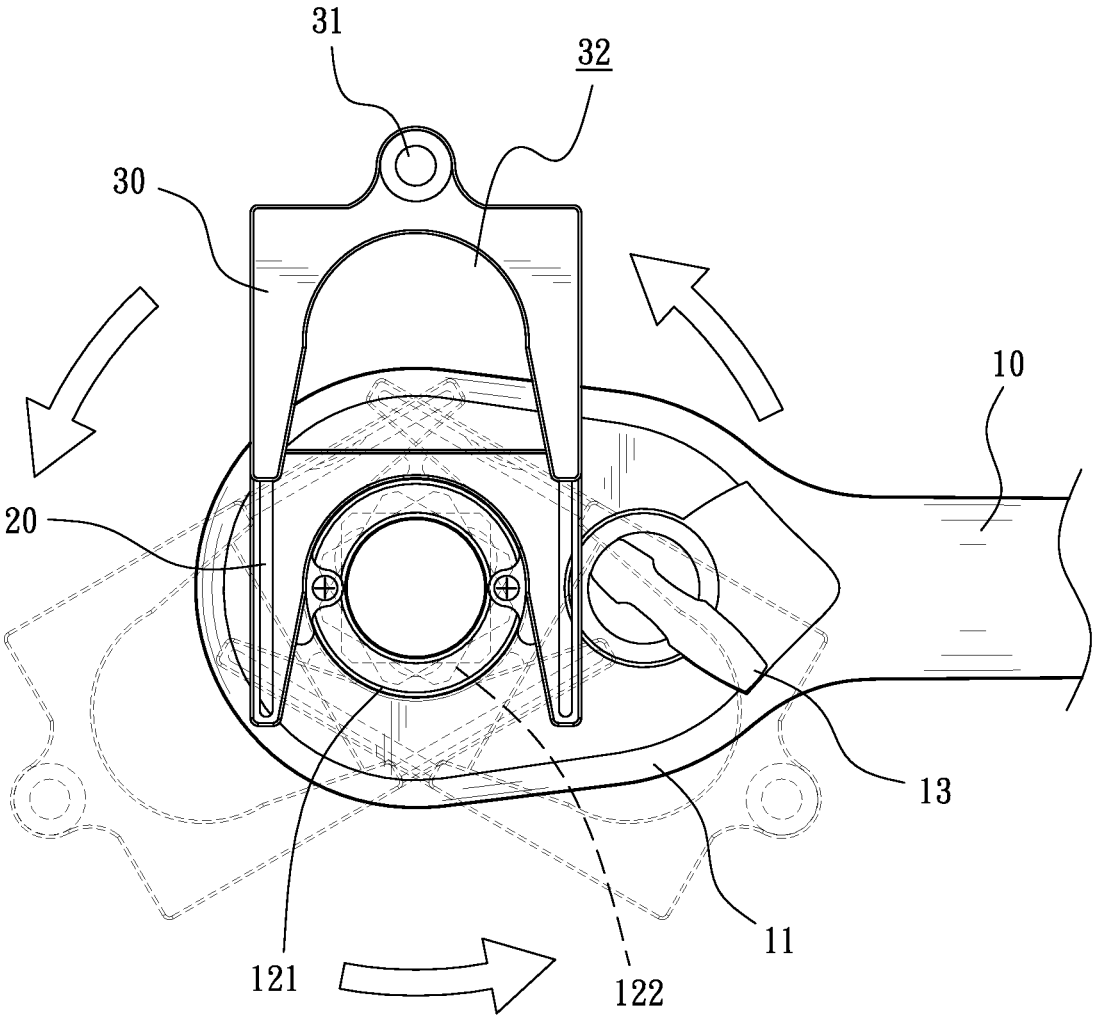
FIG. 7 is a top schematic view illustrating the seat driven by the rocker arm to rotate counterclockwise.

During the operation of the fast rotation structure of wrench, when a screw 40 fastened on an object 50 is to be removed, based on the fact that the screw 40 is still in a fastened status, a sleeve 123 with a size corresponding to the size of the screw 40 is installed on the operation portion 122 of the ratchet head 12, and then mounted on the screw 40. Next, as shown by FIG. 6, the wrench 10 is wrenched in a counterclockwise direction for unidirectionally driving the fastened screw 40 to be loosened with respect to the object 50. When the screw 40 is released to an approximately free status, the screw 40 will rotate back and forth altogether with the rotation of the wrench 10. Therefore, the rocker arm 30 slides from the folding position P1 on the seat 20 to the driving position P2, with the rocker arm 30 and the seat 20 extends to achieve a maximum length, and then the rocker handle 31 is gripped to drive the main body 121 and the operation portion 122 to rotate in a counterclockwise direction by the rocker arm 30 (as shown by FIG. 7). Alternatively, the user is able to twist the rocker arm 30 by placing a finger into the second opening 32 (not shown). With such operations, the screw 40 is driven to continuously rotate upward by the sleeve 123 (as shown by FIG. 8), so as to be removed from the object 50.

On the other hand, when the screw 40 is to be fastened onto the object 50, the sleeve 123 is mounted on the screw 40 which is placed on the object 50, and the main body 121 and the operation portion 122 are driven in a clockwise direction, such that the sleeve 123 forces the screw 40 to rotate to reach a tightness between the screw 40 and the object 50. Next, the wrench 10 is driven to continuously rotate in a clockwise direction, whereby the screw 40 on the object 50 is unidirectionally driven to be fastened.

With the foregoing configuration, advantages achievable by the present invention will be illustrated below.

When there is almost no resistance force existing between the screw 40 and the object 50 on which the screw 40 is disposed, for allowing the wrench 10 to rotate unidirectionally, the user applies the rocker arm 30 which is at the driving position P2 on the seat 20 to drive the rotation of the seat 20, so that the ratchet head 12 is driven to rotate, whereby the screw 40 is accordingly rotated with respect to the object 50. In other words, the user is able to finish the releasing or fastening operation of the screw 40 against the object 50 without the need of separating the sleeve 123 from the screw 40. Therefore, the driving operation of the screw 40 by use of the wrench 10 is facilitated, and the rotation operation efficiency of the screw 40 with respect to the object 50 is improved.

Also, regarding the wrench 10 in accordance with an embodiment of the present invention, a switch 13 is disposed adjacent to the ratchet head 12 at the driving end 11, because of a predetermined height of the seat 20, when the rocker arm 30 is at the driving position P2, the rocker arm 30 is prevented from contacting the switch 13, facilitating a smooth rotation of the rocker arm 30.

Besides operating the rocker handle 31 of the rocker arm 30, the user is also able to twist the rocker arm 30 around by placing a finger into the second opening 32 of the rocker arm 30, so as to drive the rocker arm 30 in an alternative method, facilitating the convenience of driving the rocker arm 30.

Notably, in the embodiments above, the seat 20 and the ratchet head 12 are two different components that are fastened to be combined. However, the seat 20 and the ratchet head 12 are also allowed to be integrally formed, such that the connection between the seat 20 and the ratchet head 12 remains. Further, the rocker arm 30 and the seat 20 are not limited to be combined as the aforementioned combination status. For example, the rocker arm 30 and the seat 20 are able to be integrally formed at the driving position P2.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A fast rotation structure of wrench for fast rotating a ratchet head of a wrench, comprising:

a seat having a predetermined height connected with a ratchet head; and a rocker arm integrally formed or slidably combined with the seat, the rocker arm protruding on one side of the seat for driving the seat to rotate from an outer side of the seat;

wherein the seat is formed in a U shape and has a first opening; the seat has a lower wall, such that the seat is connected with the ratchet head by the lower wall; the rocker arm has a rocker handle disposed at an end in opposite to the first opening, and the rocker handle protrudes on the rocker arm;

wherein the seat has two first lateral portions symmetrically disposed on two sides of the first opening, respectively; the rocker arm is formed in U shape and has a second opening; the rocker arm has two second lateral portions symmetrically disposed on two sides of the second opening, respectively; the two second lateral portions of the rocker arm slidably overlap the two first lateral portions, with the first opening and the second opening facing a same direction.

2. The fast rotation structure of claim 1, wherein each first lateral portion has a rail groove which emends in a straight line orientation, and the rail grooves of the two first lateral portion are arranged in parallel; each second lateral portion has a slide portion, and the two slide portions are disposed, in the rail grooves of the two first lateral portions, respectively, whereby the rocker arm disposed on the seat only moves in a straight direction between a folding position and a driving position.

3. The fast rotation structure of claim 2, wherein the lower wall has two apertures disposed on two apposite sides of the first opening, respectively, and the ratchet head has two lock holes disposed corresponding to the two apertures, such that the two apertures of the lower wall are fastened to the two lock holes through two fastening members, respectively.

4. A wrench having a fast rotation structure, comprising:

a wrench having a driving end, with a ratchet head disposed at the driving end;

a seat having a predetermined height and connected with ratchet head; and a rocker arm integrally formed or slidably combined with the seat, the rocker arm protruding on one side of the seat for driving the seat to rotate from an outer side of the seat;

wherein the seat is formed in a U shape has a first opening; the seat has a lower wall, such that the seat is connected with the ratchet head by the lower wall; the rocker arm has a rocker handle disposed at an end in opposite to the first opening, and the rocket handle protrudes on the rocker arm, wherein the seat has two first lateral portions symmetrically disposed on two sides of the first opening, respectively; the rocker arm is thrilled in a U shape and has a second opening; the rocker arm has two second lateral portions symmetrically disposed on two sides of the second opening, respectively; the two second lateral portions of the rocker arm slidably overlap the two first lateral portions, with the first opening and the second opening facing a same direction.

5. The wrench of claim 4, wherein each first lateral portion has a rail groove which extends in a straight line orientation, and the rail grooves of the two first lateral portion are arranged in parallel; each second lateral portion has a slide portion, and the two slide portions are disposed in the rail grooves of the two first lateral portions, respectively, whereby the rocker arm disposed on the seat only moves in a straight direction between a folding position and a driving position.

6. The wrench of claim 5, wherein the lower wall has two apertures disposed on two opposite sides of the first opening, respectively, and the ratchet head has two lock holes disposed corresponding to the two apertures, such that the two apertures of the lower wall are fastened to the two lock boles through two fastening members, respectively.

* * * * *